US008369558B2

(12) United States Patent
Conrad et al.

(10) Patent No.: US 8,369,558 B2
(45) Date of Patent: Feb. 5, 2013

(54) CUP-SHAPED PORTABLE SPEAKER WITH MUSIC PLAYER ADAPTER

(75) Inventors: Derek Conrad, Riverside, CA (US); Denny Tsai, Chino Hills, CA (US)

(73) Assignee: Baby Trend Inc., Ontario, CA (US)

( * ) Notice: Subject to any disclaimer, the term of this patent is extended or adjusted under 35 U.S.C. 154(b) by 274 days.

(21) Appl. No.: 12/785,044

(22) Filed: May 21, 2010

(65) Prior Publication Data

US 2011/0286622 A1 Nov. 24, 2011

(51) Int. Cl.
*H04R 1/02* (2006.01)
*H04R 5/02* (2006.01)

(52) U.S. Cl. ..... 381/386; 381/300; 381/301; 381/302; 381/303; 381/304; 381/305; 381/332; 381/333; 381/334; 381/335; 381/336; 381/388; 381/389

(58) Field of Classification Search ..... 381/300–305, 381/332–336, 386, 388, 389
See application file for complete search history.

(56) References Cited

U.S. PATENT DOCUMENTS 6,633,482 B2 10/2003 Rode
7,269,002 B1 9/2007 Turner et al.
7,524,197 B2 * 4/2009 Mills et al. ..... 439/131
7,570,918 B2 8/2009 Chen
7,611,114 B1 * 11/2009 Griffin ..... 248/311.2
2002/0160345 A1 10/2002 Hempton
2003/0032459 A1 2/2003 Kim
2004/0224638 A1 * 11/2004 Fadell et al. ..... 455/66.1
2006/0250764 A1 * 11/2006 Howarth et al. ..... 361/683
2007/0042709 A1 2/2007 Krieger et al.
2007/0230723 A1 * 10/2007 Hobson et al. ..... 381/300
2009/0067635 A1 * 3/2009 Fletcher ..... 381/17
2009/0175458 A1 * 7/2009 Smith ..... 381/28
2009/0222862 A1 9/2009 Dayan et al.
2011/0274307 A1 * 11/2011 Lynch ..... 381/389

* cited by examiner

*Primary Examiner* — Mohamad Musleh
*Assistant Examiner* — Tsz Chan
(74) *Attorney, Agent, or Firm* — Chen Yoshimura LLP

(57) ABSTRACT

A portable speaker for a music play such as an iPod® player. The housing of the speaker is shaped and sized as a cup and can be placed inside a commonly seen cup holder, such as a cup holder in a car or other vehicles, a baby stroller, a foldable camping chair, etc. The speaker housing has a slot for receiving a music player, as well as electrical connectors for electrically connecting to the audio output of the music player. The sound producing devices are disposed within the speaker housing and face upwards and/or downwards.

6 Claims, 3 Drawing Sheets

CUP-SHAPED PORTABLE SPEAKER WITH MUSIC PLAYER ADAPTER

BACKGROUND OF THE INVENTION

1. Field of the Invention

This invention relates to a speaker with a music player adapter.

2. Description of the Related Art

Various adaptors have been designed to fit into a standard cup holder to hold objects other than cups, such as music players and other electronic devices. For example, U.S. Pat. No. 7,611,114 describes a portable music player holder: "A holder for a digital audio player such as an Apple iPOD™ is designed to fit in a standard sized cup holder. The holder is configured to support the digital audio player at an easy to read angle and provides a slot for a cable such as a power cable to extend from the holder."

U.S. Pat. No. 7,570,918 describes: "A multimedia device comprises a host, which comprises a connection unit, a control unit for controlling connection of the connection unit to an external mobile electronic device to charge the connected mobile electronic device and to transmit multimedia music from the connected mobile electronic device to a FM channel of a car audio radio system for broadcasting, and a display unit controllable by the control unit to display the current operation status of the control unit, and a holder member coupled to the host and radially adjustable for securing the host to a cup holder for motor vehicle."

U.S. Pat. No. 7,269,002 describes "an apparatus that can secure an electronic device into a vehicle recess . . . . The apparatus provides a vehicle-specific integrated docking station for a digital media player, e.g. Apple's iPod. The docking station contains a connecting assembly to interface the digital media player to a digital media interface than in turn is connected to a vehicle audio system. The vehicle recess may be an ashtray recess, a change-tray recess, a cup-holder recess or other appropriate recess."

U.S. Pat. No. 6,633,482 describes "A system for installing an interactive driver information system into an existing vehicle . . . . An off-the-shelf driver-to-vehicle interface device such as a PDA is received in a corresponding docking station. A custom adapter device mechanically and electrically receives the PDA components and enables a mechanical and electrical connection from the PDA components to the vehicle. The custom adapter device is configured in a variety of embodiments to interfit with a pre-existing cavity in the vehicle such as a cup holder, ashtray cavity, coin holder, or seam in the dashboard. The custom adapter device further provides an electrical connection from the PDA components to the power system of the vehicle and to an electronic on board controller. The PDA docking station may be structurally integrated with a microphone, a speaker, and a control panel of manually operable elements to be manipulated by a driver." The PDA docking station, in which the speaker may be integrated, is not the custom adaptor that fits into pre-existing cavity in the vehicle such as a cup holder.

U.S. Pat. Appl. Pub. No. 20090222862 describes "a multimedia playing device for use in a vehicle. The multimedia playing device is mounted within the dashboard of a vehicle and is able to wirelessly transmit video to various display devices located in the vehicle. The multimedia playing device is able to accommodate any number of multimedia playing devices. The audio may be directly transmitted to the stereo system of the vehicle. In another aspect, the invention is a docking device for use in a vehicle. The docking device is adapted to be placed within the cup holder of a vehicle. An external media device is connected to the docking device in order to transmit the video and audio data. The docking device is able to wirelessly transmit video to display devices located in the vehicle. The audio may be directly transmitted to the stereo system of the vehicle and/or to the display device."

U.S. Pat. Appl. Pub. No. 20070042709 describes: "An audio device comprises a satellite receiver for receiving an audio signal via a receive antenna. A transmitter transmits the audio signal to an external receiver via a transmit antenna for remote rendering of the audio signal. A cup-shaped housing encloses the satellite receiver and the transmitter. The cup-shaped housing is configured for insertion into a cup holder to securely position the audio device inside a vehicle."

U.S. Pat. Appl. Pub. No. 20030032459 describes "a hands-free kit for mobile phones used while being mounted on a cup holder of an automobile. The hands-free kit includes a cup-shaped body, a speaker unit and a remote controller . . . . The speaker unit serves to amplify and output voice from the mobile phone, and is provided with a flexible boom for connecting the speaker unit to the body and allowing the speaker unit to be freely rotated."

U.S. Pat. Appl. Pub. No. 20020160345 describes a child cup holder that has a speaker integrated into the cup holder.

SUMMARY OF THE INVENTION

The present invention is directed to a portable speaker with music player adapter, where the speaker has the general shape of a cup and can be placed in a standard cup holder.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a portable speaker which includes: a housing having a cylindrical or tapered cylindrical outer shape; one or more sound producing devices enclosed within the housing; an electrical circuit disposed within the housing for controlling the sound producing devices; one or more electrical connectors disposed on the housing and electrically connected to the electrical circuit; and a slot extending into an interior of the housing for receiving a music player.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1A:
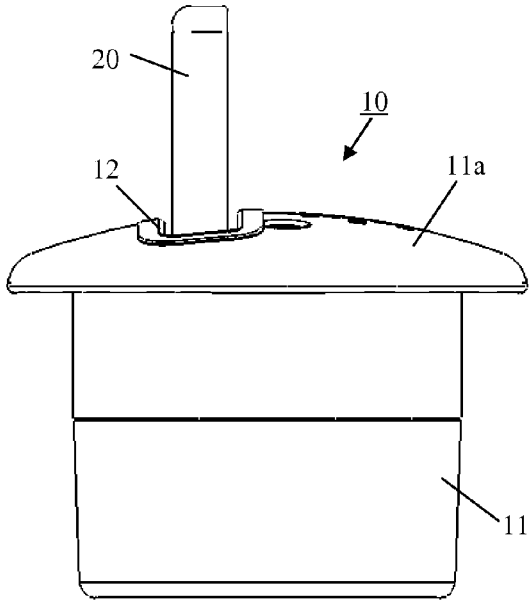
FIGS. 1*a*-1*e* are side, front, back, top and bottom views of a speaker according to an embodiment of the present invention.
Figure 1B:
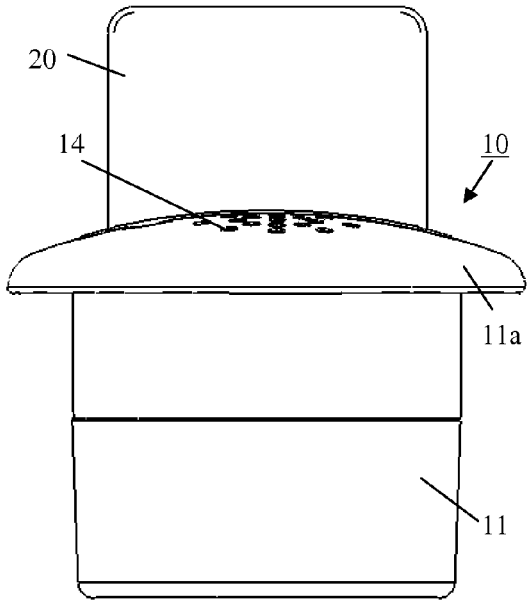
Figure 1C:
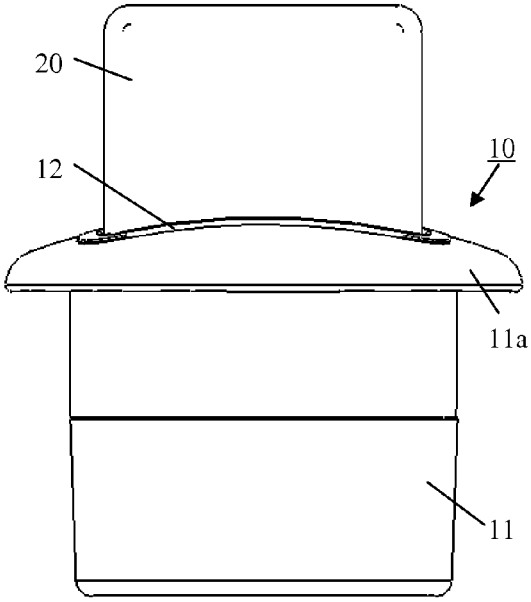
Figure 1D:
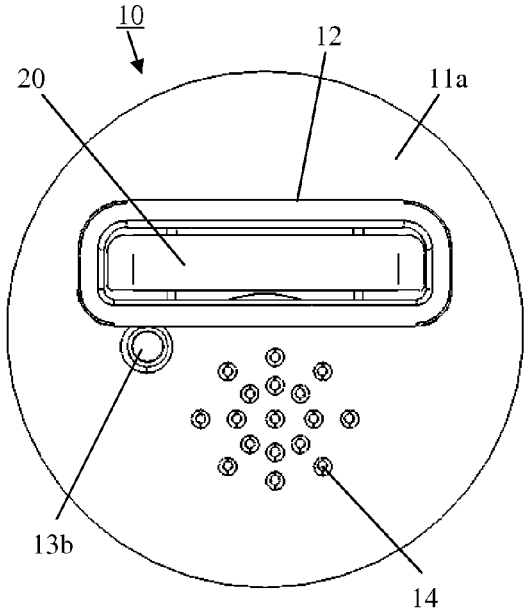

Embodiments of the present invention provides a portable speaker for a music player such as an iPod® player. The housing of the speaker is shaped and sized as a cup and can be placed inside a commonly seen cup holder, such as a cup holder in a car or other vehicles, a baby stroller, a foldable camping chair, etc. The speaker housing has a slot for receiving a music player, as well as electrical connectors for electrically connecting to the audio output of the music player.

The sound producing devices are enclosed within the speaker housing and face upwards and/or downwards.

FIGS. 1*a*-1*d* are side, front, back and top views of a speaker 10 according to an embodiment of the present invention. The housing 11 of the speaker 10 has a cylindrical or slightly tapered cylindrical outer shape, with an outer diameter of approximately 2 to 3.5 inches and a height of at least 2 inches. In one particular embodiment, the housing 11 has an outer diameter of about 2.5 inches at the bottom and about 3 inches at the top, and a height of about 3 inches. The diameter of the housing 11 is selected such that the housing will fit inside a cup holder of commonly seen size without too much gap between the housing and the cup holder. Common cup holders have a diameter of approximately 2.5 to 3.5 inches. Of course, a speaker having the general shape as shown in FIGS. 1*a*-1*d* may have a larger or smaller diameter if it is designed to fit in a cup holder of a special size that is larger or smaller than commonly seen cup holders.

In a preferred embodiment, the housing 11 is made of a rigid material such as plastics. In another embodiment, the housing 11 may be made to have a layer of compressible materials such as foam or resilient materials such as spring plates on its outside, so that the housing can fit into cup holders of different sizes. In yet another embodiment, the housing may be made to have adjustable diameters.

In the particular embodiment shown in FIGS. 1*a*-1*d*, the housing 11 has a top portion 11*a* that has a larger diameter than the lower portion of the housing. When the housing 11 is inserted into a cup holder, the top portion 11*a* is above the rim of the cup holder. The shape of the top portion 11*a* is a design choice; alternatively, the top portion 11*a* may be omitted and the entire housing may have a substantially uniform diameter or a tapered shape.

A slot 12 is provided that extends from the top surface of the housing 11 into the interior of the housing for receiving a music player 20. The slot 12 may extend vertically down or may be slanted. The size and shape of the slot 12 may be designed to fit a music player of a particular size and shape, or designed to have a sufficiently large size to accommodate music players of commonly seen sizes and shapes. In one embodiment, the slot is approximately 2 to 3 (preferably 2.5) inches deep, 2.5 to 2.75 inches wide and ½ to ⅝ inches thick. The depth of the slot is not important, so long as the music player can securely sit inside the slot. The music player 20, which is not a part of the speaker 10, is inserted into the slot when the speaker is in use, and can be removed when the speaker is not in use.

Figure 2:
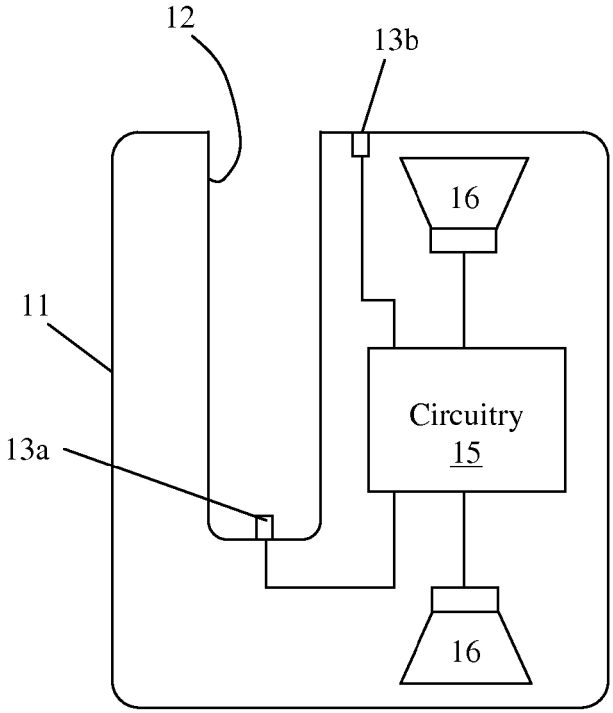
FIG. 2 schematically illustrates the internal structures of the speaker.

FIG. 2 schematically illustrates the internal structures of the speaker 10. As shown in FIG. 2, one or more electrical connectors 13*a*, 13*b* are provided inside the slot 12 and/or on an outside surface (e.g. the top surface) of the housing 11. In one implementation, the speaker 10 is designed for use with a music player 20 that has a pin connector on its bottom with pre-defined mechanical and electrical specifications. A pin connector 13*a* having corresponding mechanical and electrical specifications is provided at the bottom of the slot 12 and can mate with the connector of the music player. The music player 20 is firmly inserted into the slot 12 so that the connectors of the music player and the speaker are electrically connected with each other. In another embodiment, a plug hole 13*b* is provided on the top surface of the housing 11 so that an adaptor cable (not shown) can be plugged into the plug hole to electrically connect the music player 20 with the speaker 10. The speaker 10 may have both connectors 13*a* and 13*b* or only one of them.

Figure 1E:
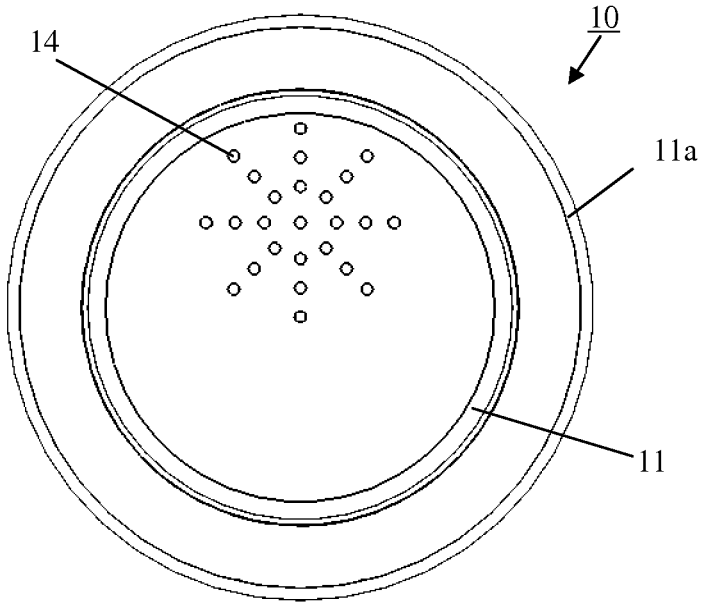

One or more sound producing devices 16 (sometimes also referred to as speakers), electrical circuitry 15, and batteries (optional, not shown) are housed within the housing 11. The circuitry 15, is electrically connected to the connectors 13*a*, 13*b*, receives output audio signals from the music player 20 and controls the sound producing devices. In a preferred embodiment, one sound producing device is located near the top surface of the housing 11 facing upwards. The top surface of the housing 11 is provided with a plurality of orifices 14 (see FIG. 1*d*), or is partially made of a mesh material, to facilitate the propagation of the sound. In one embodiment, a second sound producing device is provided near the bottom of the housing facing downwards, and the bottom surface of the housing 11 may also be provided with orifices 14 (see FIG. 1*e*) or a mesh material.

In one embodiment, the speaker housing 11 has a battery compartment, so that the speaker can be used without being connected to an external power source. In another embodiment, the speaker 10 has a power cord or can receive a power cord from an external power source, such a 12V source of a vehicle.

Figure 3:
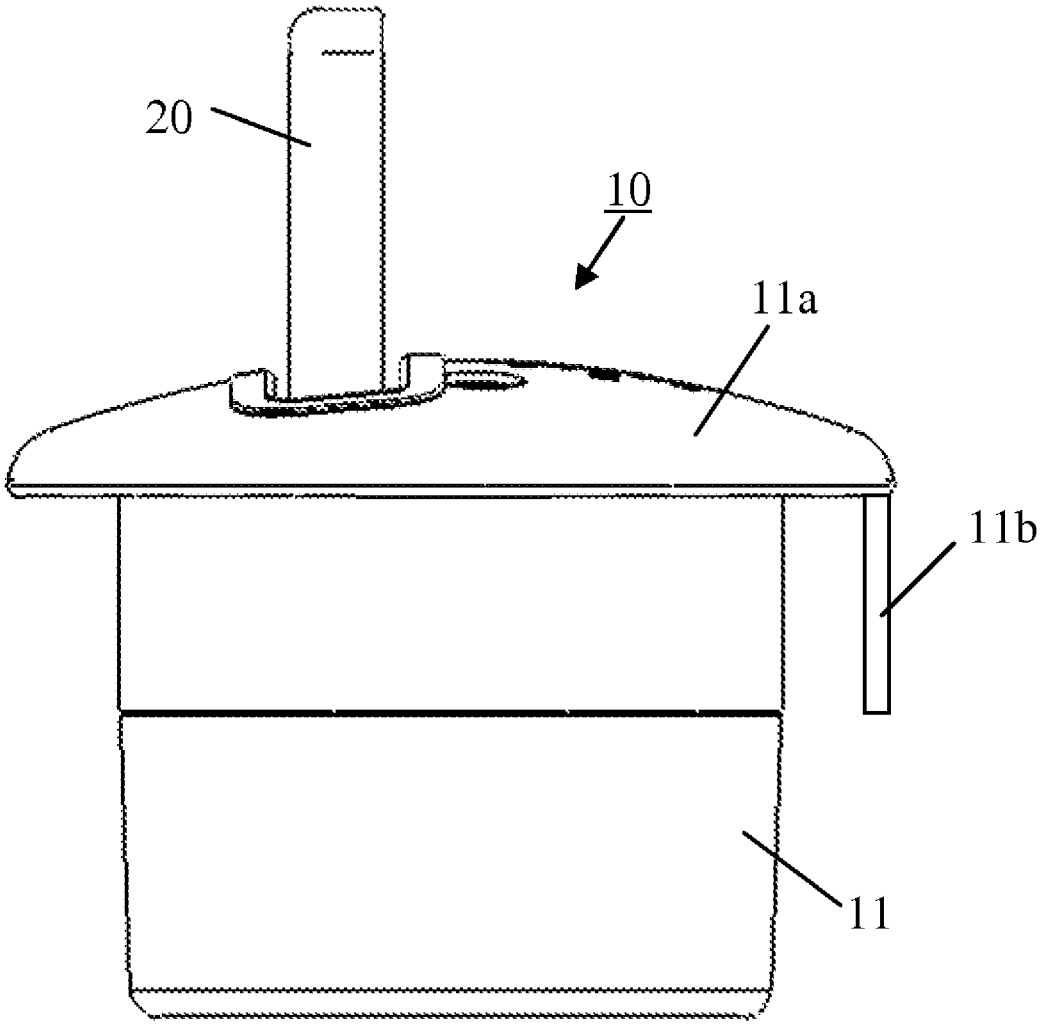
FIG. 3 is a side view of a speaker according to another embodiment of the present invention which includes a hook.

The speaker 10 may be provided with additional features to make it more convenient to use and/or more versatile. For example, as shown in FIG. 3, the housing 11 is provided with a hook 11*b* disposed near a top end of the housing, such as on the rim of the top portion 11*a*. This allows the speaker 10 to be conveniently hung from a suitable object. The hook 11*b* may be made removable. Alternatively, an accessory ring may be provided with the speaker, where the accessory ring has a hook for hanging to a suitable object and an inner diameter sized to receive the speaker 10.

It will be apparent to those skilled in the art that various modification and variations can be made in the speaker with music player adapter of the present invention without departing from the spirit or scope of the invention. Thus, it is intended that the present invention cover modifications and variations that come within the scope of the appended claims and their equivalents.

What is claimed is:

1. A portable speaker comprising:

a housing having a cylindrical or tapered cylindrical outer shape, the housing defining a slot extending into an interior of the housing for receiving a music player, wherein a top surface of the housing defines a plurality of orifices on the top surface and a bottom surface of the housing defines a plurality of orifices on the bottom surface;

first and second sound producing devices enclosed within the housing, wherein the first sound producing device is disposed near the top surface of the speaker facing upwards toward the top surface, and the second sound producing device is disposed near the bottom surface of the speaker facing downwards toward the bottom surface;

an electrical circuit disposed within the housing for controlling the sound producing devices; and one or more electrical connectors disposed on the housing and electrically connected to the electrical circuit.

2. The portable speaker of claim 1, wherein the housing has an outer diameter of about 2 to 3.5 inches and a height of at least 2 inches.

3. The portable speaker of claim 1, wherein the slot has a size of about 2 to 3 inches deep, 2.5 to 2.75 inches wide and ½ to ⅝ inches thick.

4. The portable speaker of claim 1, wherein the one or more electrical connectors includes a plug hole disposed on a top surface of the housing.

5. The portable speaker of claim 1, wherein the one or more electrical connectors includes an electrical connector disposed inside the slot.

6. The portable speaker of claim 1, wherein the housing further comprises a hook disposed near a top of the housing.

* * * * *